United States Patent [19]

Ostergaard

[11] Patent Number: 4,925,114

[45] Date of Patent: May 15, 1990

[54] IMPELLER BAR INSTALLATION AND REPOSITIONING MEANS FOR IMPACT CRUSHERS HAVING "OPEN" TYPE ROTORS

[75] Inventor: David A. Ostergaard, Cedar Rapids, Iowa

[73] Assignee: Cedarapids, Inc., Cedar Rapids, Iowa

[21] Appl. No.: 368,975

[22] Filed: Jun. 19, 1989

Related U.S. Application Data

[63] Continuation of Ser. No. 182,120, Apr. 15, 1988, abandoned.

[51] Int. Cl.[5] ..... B02C 13/28

[52] U.S. Cl. ..... 241/191; 144/230; 241/189 R; 241/294; 407/41; 407/49

[56] References Cited

U.S. PATENT DOCUMENTS

| | | | |
|---|---|---|---|
| 995,024 | 6/1911 | Mitchell | 144/230 |
| 1,714,098 | 5/1929 | Miller | 407/41 X |
| 2,258,075 | 10/1941 | Symons . | |
| 2,660,242 | 11/1953 | Lane | 83/677 X |
| 2,747,803 | 5/1956 | Hanse . | |
| 2,958,474 | 11/1960 | Meyer . | |
| 3,146,961 | 9/1964 | Putman, Jr. . | |
| 3,151,816 | 10/1964 | Hanse et al. . | |
| 3,170,643 | 2/1965 | Hanse et al. | 241/189 R |
| 3,202,368 | 8/1965 | Nixon . | |
| 3,355,113 | 11/1967 | Meger et al. . | |
| 3,455,517 | 7/1969 | Gilbert . | |
| 3,645,459 | 2/1972 | Lucas et al. . | |
| 3,659,793 | 5/1972 | Stephenson et al. . | |
| 3,660,879 | 5/1972 | Erkfritz | 407/41 |
| 3,784,117 | 1/1974 | Koenig et al. . | |
| 3,865,164 | 2/1975 | Sybertz | 241/294 X |
| 3,874,603 | 4/1975 | Lowe et al. . | |
| 3,904,139 | 9/1975 | Maier et al. . | |
| 3,979,078 | 9/1976 | Boddeker et al. . | |
| 4,162,770 | 7/1979 | Lewis . | |
| 4,373,678 | 2/1983 | Reitter . | |
| 4,573,643 | 3/1986 | Orphall et al. . | |
| 4,597,538 | 7/1986 | Getz . | |
| 4,679,740 | 7/1987 | Orphall . | |

*Primary Examiner*—Joseph M. Gorski

*Attorney, Agent, or Firm*—Simmons, Perrine, Albright & Ellwood

[57] ABSTRACT

The impeller bars on an "open" type rotor of an impact crusher are clamped to each disc of the rotor by means of pairs of cooperating wedges. Each pair of wedges consists of a first wedge acting radially outwards of the rotor between the disc and the impeller bars and a second wedge acting axially of the rotor between the disc and the first wedge to drive the first wedge radially outwards. Means including a hook are also disclosed for lifting the impeller bars onto the rotor for initial installation as well as for later repositioning of the bars to compensate for wear.

7 Claims, 3 Drawing Sheets

FIG 1
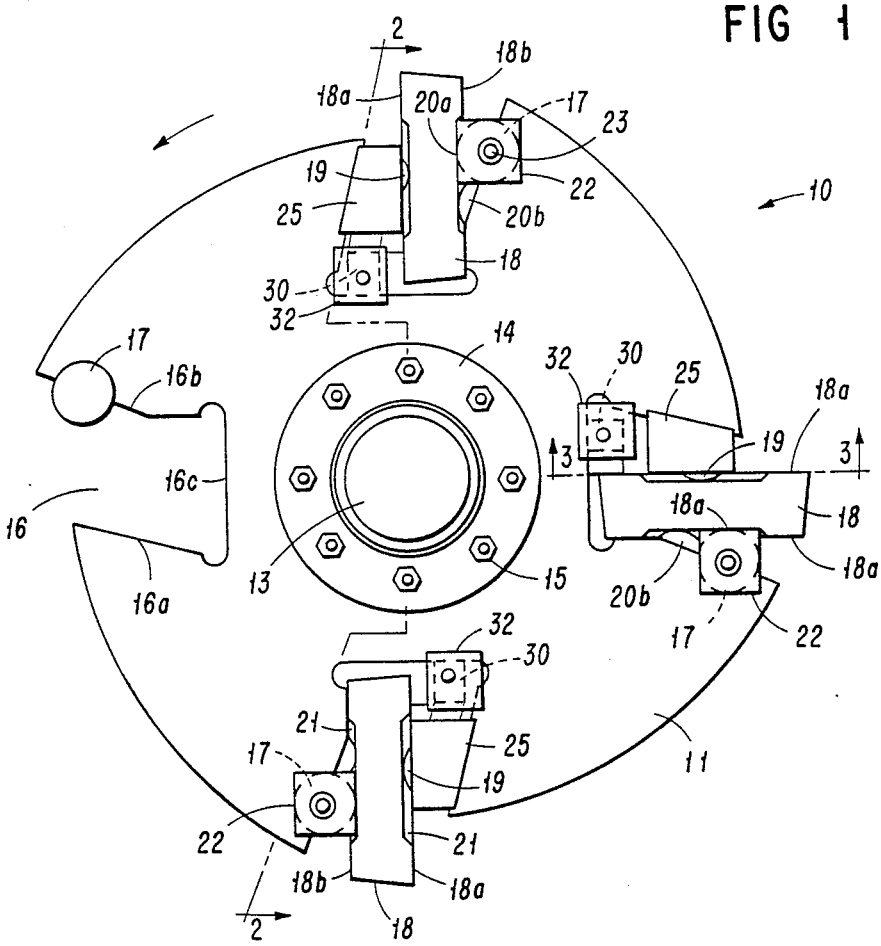
FIG 4
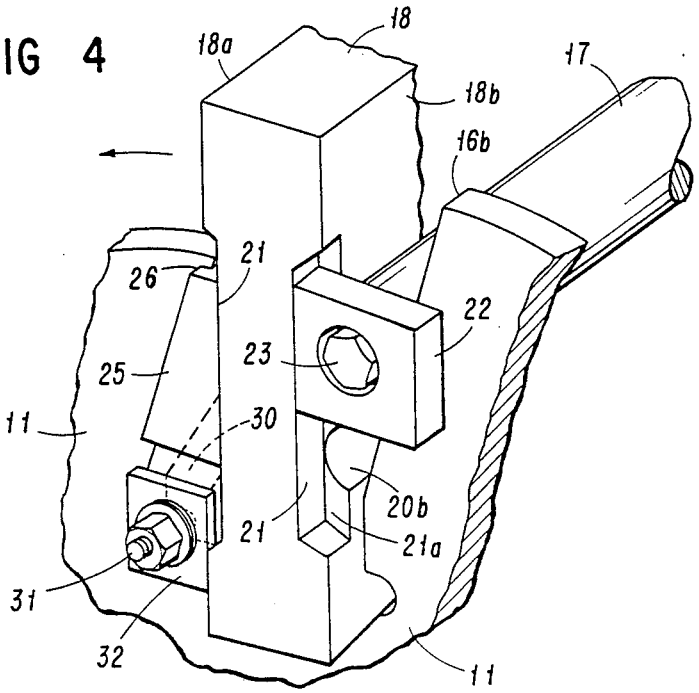
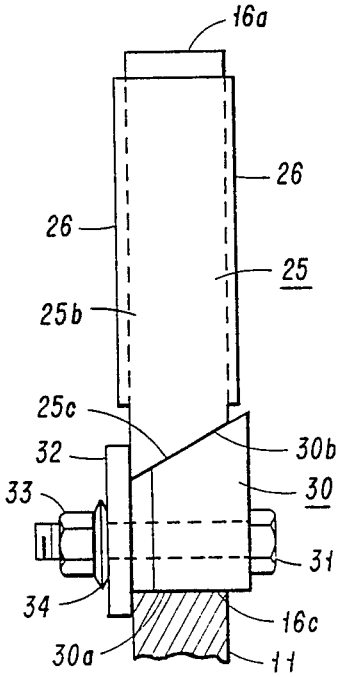
FIG 3

FROM POSITION 1 TO 2
FROM POSITION 2 TO 3
FROM POSITION 3 TO 4
POSITION 1

POSITION 2

POSITION 3

POSITION 4

IMPELLER BAR INSTALLATION AND REPOSITIONING MEANS FOR IMPACT CRUSHERS HAVING "OPEN" TYPE ROTORS

This is a continuation of co-pending application Ser. No. 182,120 filed on Apr. 4, 1988 and now abandoned.

BACKGROUND OF THE INVENTION

Impact crushers of the impeller type typically utilize a rotor having several axially extending impeller bars disposed in recesses about its periphery. The impeller bars strike the rock entering the crusher and hurl it against one or more sets of breaker bars in the process of reducing the rock to size. From time to time the impeller bars, since they are abraded by the rock, must be adjusted to compensate for wear and then finally replaced which in turn requires that they be removably attached to the rotor. At the same time the attachment must be mechanically secure and rigid enough for the bars to withstand the rapid and repeated blows with which they strike the rock.

The prior art abounds with schemes for removably affixing impeller bars to their rotors. The most prevalent, it seems, employ wedges of various configurations and functions, whether the rotors themselves are of the "solid" cast type or of the "open" type consisting of several axially spaced discs. Generally speaking, the wedges in these instances act in one of two ways: either radially of or axially of the rotor. Examples of the first kind are found in U.S. Pat. Nos. 2,747,803; 3,784,117; 3,979,078; 4,573,643; and 4,679,740. Examples of the second kind are shown in U.S. Pat. Nos. 2,258,075; 3,202,368; 3,455,517; 3,874,603; and 4,373,678. But in varying degrees all of the foregoing suffer from one or more of the following: complexity, weight, poor accessibility for inspection, adjustment or replacement, high manufacturing costs, and "liming" which increases the difficulty of adjustment or replacement. So the chief object of the present invention is a wedging arrangement for the impeller bars of an "open" type rotor which reduces or eliminates the impediments and detractions typical of the prior art. Another object of the invention is a simple but effective manner of manipulating the impeller bars when installing them initially and for repositioning them later to compensate for wear.

SUMMARY OF THE INVENTION

The wedging arrangement of the invention employs a pair of wedges removably securing each impeller bar to its respective rotor disc. Each pair of wedges consists of a first wedge acting radially of a rotor disc between the side wall of a recess in the disc and the leading face of the impeller bar, and a second wedge acting axially of the disc between the radially inner end wall of the recess and the radially inner end of the first wedge. The latter end of the first wedge is provided with a wedging face which mates with a cooperating wedging face on the second wedge, the latter wedge being urged against the first wedge by a bolt axially through the second wedge, on the one hand, and an anchor plate and nut operative against one face of the rotor disc, on the other hand.

The parts involved are simple, relatively light in weight, easily manufactured, and readily accessible either for inspection or for adjustment or replacement of the impeller bars on account of wear. Liming between the parts is quickly broken by a few hammer blows once the bolts through the second wedges are removed. Each impeller bar is provided with a hole through it from side to side at its center of gravity so that the bar can be lifted onto the rotor by a hook. When the bar is later to be repositioned to compensate for wear, the hook lifts the bar from the rotor and allows it while suspended to be rotated on or by the hook before being reinstalled in a new position on the rotor. Other features and advantages of the present invention will become apparent from the drawings and the more detailed description which follows.

BRIEF DESCRIPTION OF THE DRAWINGS

FIG. 1 is an end view of an "open" type rotor of an impact crusher illustrating the installation of the impeller bars according to the invention, one set of bars being omitted in order to depict the configuration of one of the recesses in the rotor discs.

FIG. 3 is a sectional view taken along the line 3—3 of FIG. 1.

FIG. 4 is a perspective view of a portion of the rotor of FIG. 1 showing the installation at the outer end of one of the breaker bars.

DETAILED DESCRIPTION OF THE PREFERRED EMBODIMENT

Figure 2:
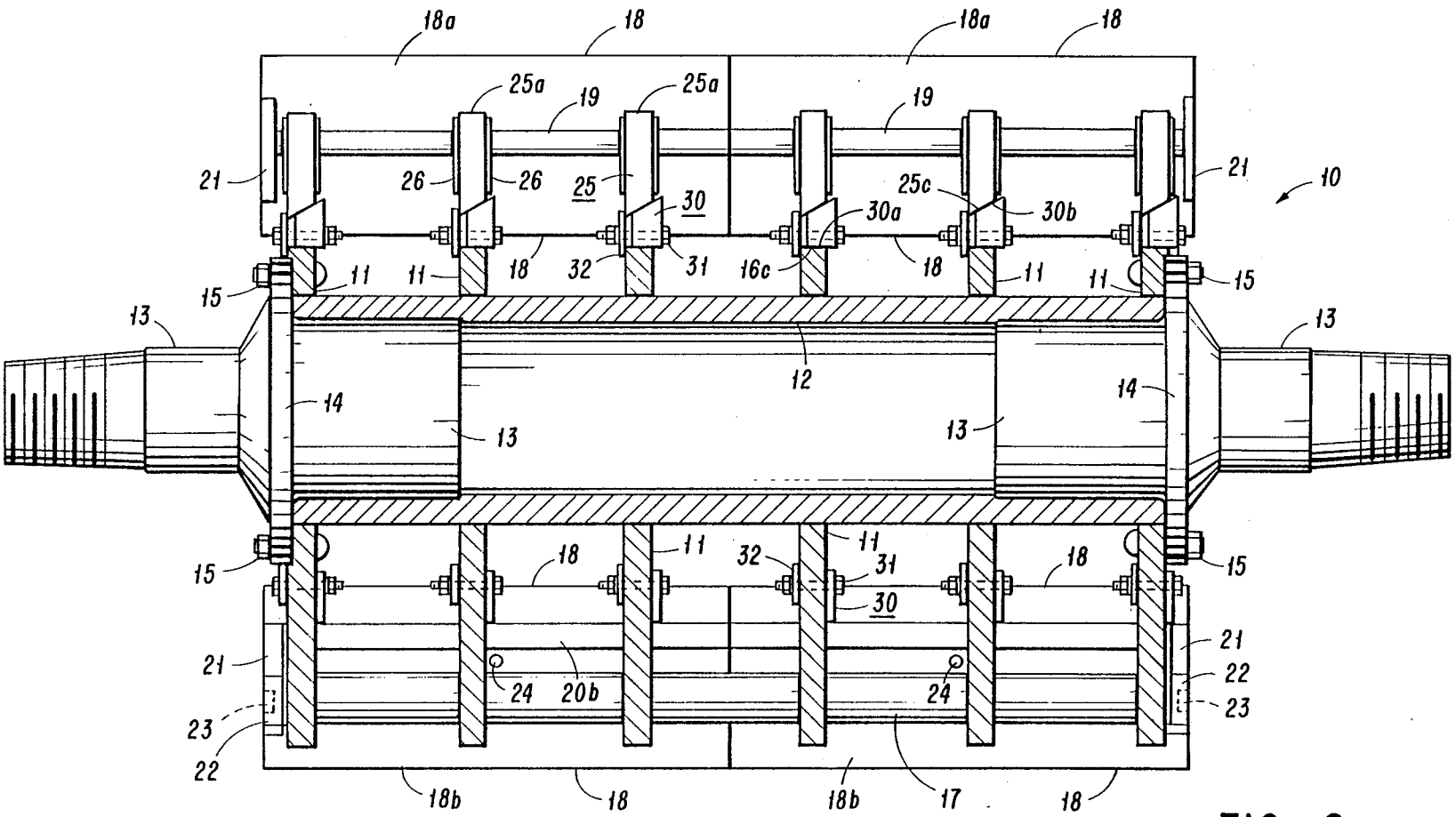
FIG. 2 is a sectional view of the rotor taken along the line 2—2 of FIG. 1.

Referring first to FIGS. 1 and 2, the rotor 10 consists of a number of discs equally axially spaced along a cylindrical tube 12 to which the discs 11 are welded. The tube 12 is counterbored at each end into which are fitted a pair of hubs 13 having flanges 14 bolted at 15 to the two end-most discs 11, whence the rotor 10 revolves about the axis of the tube 12 and hubs 13. The discs 11 are provided with four sets of axially aligned recesses 16 equally spaced about their peripheries. It will be understood, of course, that the recesses 16 could be greater or fewer in number without affecting the endeavor of the invention. Each recess 16 extends generally radially inwards and, with respect to the direction of rotation indicated by the arrow in FIG. 1, includes a leading side wall **16*a*, an opposing trailing side wall 16*b* and an end wall 16*c* of the spacing and configuration shown at the left in FIG. 1, the trailing side walls 16*b* having a greater radial extent than the leading side walls 16*a*. Adjacent their outer ends the trailing side walls 16*b* of each set of recesses 16 are circularly relieved to partially encompass a cylindrical back-up bar 17 welded to the discs 11**.

Each set of disc recesses 16 in turn receives a pair of impeller bars 18 disposed end-to-end, each impeller bar 18 being rectangular in plan but slightly trapezoidal in cross-section for casting purposes. Each bar 18 is cast with an axially extending, shallow seat 19 in its leading side wall **18*a* midway between its radially inner and outer ends (see FIGS. 1 and 2) and concentric with the back-up bars 17. The trailing side wall 18*b* of each impeller bar 18, which is parallel to the leading side wall 18*a*, is cast with a pair of similar, radially spaced seats 20*a*, 20*b*, the outer seat 20*a* of each bar 18 receiving the back-up bar 17 when the impeller bars 18 are initially installed, as shown in the drawings. In that position the radially inner portions of the bar side walls 18*b* abut the radially inner portions of the recess side walls 16*b* and the recess side walls 16a and the bar side walls 18a converge towards each other in a radially outward direction. The outer axial ends of each pair of impeller bars 18 overhang the outboard faces of the two end discs 11, as shown in FIGS. 2 and 4, each end of the bars 18 being provided with a pair of opposite, radially elongated insets 21 having axially inner faces 21a flush with the outer faces of the discs 11 (see FIGS. 2 and 4). The impeller bars 18 are held against axial movement by retainer blocks 22 overlapping the discs 11 and the bar inset faces 21a, the blocks 22 being counterbored to encompass the heads of bolts 23 securing the blocks 22 to the axial end faces 17a ends of the back-up bars 17 (see FIGS. 2 and 4). Each impeller bar 18 is also provided with a circular hole 24 (see FIG. 2) from its side wall 18a through its side wall 18b and located at its center of gravity, that is to say in this case, at the geometrical centers of the side walls 18a, 18b**, all for the purposes to be described.

As previously noted each impeller bar 18 is clamped to the discs 11 by a pair of wedges disposed in the recesses 16 of each disc 11. The first wedges 25 act radially outwards between the converging recess side walls 16a and impeller bar side walls 18a, the wedges 25 having wedging faces 25a (see FIG. 2) operative along the recess side walls 16a and wedging faces 25b (see FIG. 3) operative along the impeller bar side walls 18a. The wedges 25 are axially retained in position by partial lips 26 (see FIGS. 2, 3 and 4) which straddle the faces of the discs 1, the wedges 25 extending radially inwards of the lips 26 and provided at their radially inner ends with transverse wedging faces 25c (see FIGS. 2 and 3). The second wedges 30 act axially between the recess end walls 16c and the faces 25c of the first wedges 25, the wedges 30 having wedging faces 30a operative across the recess end walls 16c and wedging faces 30b (see FIGS. 2 and 3) cooperating with the faces 25c of the first wedges 25. The wedges 30 are urged axially of the discs 11 by axially directed, headed bolts 31 through the wedges 30 and anchor plates 32 overlying the faces of the discs 11 at the converging ends of the disc recess end walls 16c and the faces 25c of the first wedges 25. When nuts 33 at the other ends of the bolts 31 are tightened, axial movement of the wedges 30 forces the wedges 25 radially outwards by virtue of the cooperating wedging faces 25c and 30b. Belleville washers 34 (see FIG. 3) are preferably interposed between the plates 32 and nuts 33 to maintain tension on the wedges 30 in all events. Hence the impeller bars 18 are held securely in position between the disc recess side walls 16b and the back-up bars 17 on the one hand, and the wedges 25 on the other hand. Note that the wedges 25 and 30 are simple in structure and of relatively light weight. They are easily manufactured inasmuch as tolerances are not critical since the wedges 30 at all times act positively on the wedges 25 and the bolts 31 and anchor plates 32 in turn on the wedges 30. Cracking, breakage or loosening of any of the wedges 25 or 30 can also be readily observed during routine inspection of the rotor 10. Should the wedges 25 and 30 loosen for some reason, the retainer blocks 22 will prevent the impeller bars 18 from moving axially and striking the end walls (not shown) of the housing about the rotor 10.

Figures 5A, 5B, 5C, 5D:
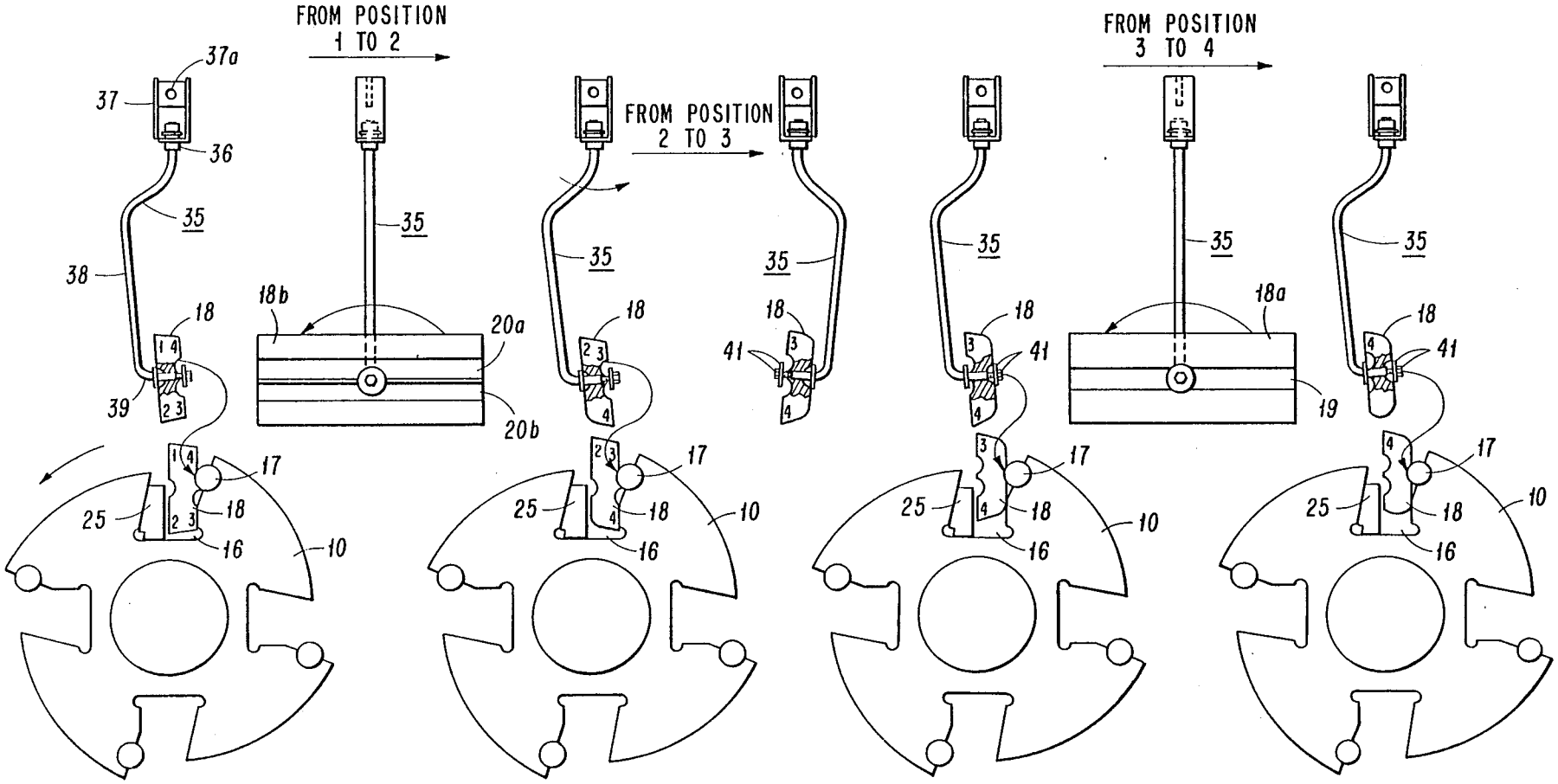
FIGS. 5A–5D illustrate the sequential manner in which the impeller bars are repositioned to compensate for wear.

Turning now to FIGS. 5A–5D, and assuming that the crusher housing is of the split type which has been swung open to expose the top of the rotor 10, in order to install the impeller bars 18 initially the rotor 10 is turned so that one set of its recesses 16 is uppermost. Then the wedges 25 are fitted loosely in place and the bars 18 lowered into the upper set of recesses 16. This is easily accomplished by engaging the hole 24 through each bar 18 with a long hook 35 having an upper end swiveled at 36 in a bracket 37 which can be pivotally attached at 37a to a suitable hoist or other lifting device. The hook 35 includes an offset, canted shank portion 38 and a lower end in the form of a stub 39 in the plane of the shank portion 38. The stub 39 is circular in cross-section, upwardly inclined about 10 degrees from the horizontal, and disposed so that the center of gravity of the bar 18 lies along the axis of the swivel 36, all as shown in FIG. 5A. The stub 39 is fitted with a stop-washer 40 such that when initially engaged with the bar 18 the stub 39 terminates therewithin. A bolt and washer 40 are then installed in a tapped drilling in the end of the stub 39 to secure the bar 18 on the hook 35. The bar 18 is then raised by the hook 35 above the rotor 10 and lowered towards the rotor 10. Just before the bar 18 is placed in the disc recesses 16 the bolt and washer 41 are removed in order to clear the back-up bar 17. The bar 18 is then as shown in "Position 1" of FIG. 5A. The retainer blocks 22 and wedges 30 are next installed and the procedure repeated for the remaining sets of impeller bars 18.

When the leading edges "1" of the impeller bars 18 are too worn, the rotor 10 is again turned so that one set of the bars 18 is uppermost, after which their retainer blocks 22 and wedges 30 are removed. Owing to their ready accessibility removal of the wedges 30 is easily accomplished, once the bolts 31 and anchor plates 32 are withdrawn, simply by striking the smaller ends of the wedges 30 with a hammer to break any "liming" between the discs 11 and the wedges 25 and 30. After the wedges 30 are removed, a few hammer blows on the wedges 25 will drive them radially inwards and loosen the impeller bars 18. The hook 35 is then engaged with each bar 18 and the latter lifted free of its rotor recesses 16 and the bolt and washer 41 installed. The bar 18 is then rotated 180 degrees on the hook stub 39, it being understood that the length of the shank 38 is sufficient so that the bar 18 when rotated clears the swivel 36. The bar 18 is then lowered back into its recesses 16 to "Position 2" (FIG. 5B), after removal of the bolt and washer 41, with the back-up bar 17 engaged with the bar seat 20b, whereby the edge "2" becomes the leading one. Finally, the retainer blocks 22 and wedges 30 are reinstalled.

After the edges "2" become worn out, the bars 18 are again lifted by the hook 35 and momentarily placed aside on any convenient platform. The hook 35 is then removed, inserted from the other side of the bars 18, and the latter lifted once again. The bars 18 and hook 35 are next rotated 180 degrees about the vertical axis of the swivel 36 and reinstalled in "Position 3" (FIG. 5C), whereby the back-up bars 17 engage the bar seats 19 and the edges "3" become the leading ones. When the edges "3" are too worn, the bars 18 are lifted once more, rotated 180 degrees on the hook stub 39 and reinstalled in "Position 4" (FIG. 5D), the back-up bars 17 again engaging the bar seats 19 and the last edges "4" becoming the leading ones. After wear of the latter, new impeller bars must be installed. Note that the use of a hook in the foregoing manner is not limited to the particular impeller bars shown nor to the particular manner of their attachment to the rotor. Most any impeller bar for an "open" type rotor can be apertured, as are the bars 18, and installed and later repositioned to compensate for wear using a like hooking arrangement.

Though the present invention has been described in terms of a particular embodiment, being the best mode known of carrying out the invention, it is not limited to that embodiment alone. Instead the following claims are to be read as encompassing all adaptations and modifications of the invention falling within its spirit and scope.

I claim:

1. A rotor assembly for an impact crusher, comprising a rotor having a rotational axis and at least one pair of axially spaced rotor discs extending radially of the rotor assembly with respect to said axis, the discs having axially aligned sets of recesses transversely therethrough and equally spaced thereabout, the recesses extending generally radially inwards from the periphery of each disc, each disc recess having a pair of opposed first and second spaced side walls and a radially inner end wall extending transversely of the disc, an axially extending impeller bar disposed in each disc recess, each impeller bar having first and second opposite, outward facing side walls, the bar first side wall being in opposed spaced relation to the disc recess first side walls, the disc recess first side wall and bar first side walls converging towards each other in a generally radially outwards direction, and first means operative between the disc recess first side wall and bar first side wall and second means operative between the disc recess second side wall and bar second side wall for retaining each impeller bar in its respective disc recess, the first retaining means for each disc recess including: first and second wedges, the first wedge being disposed between the disc recess first side wall and bar first side wall and movable therebetween in a generally radially outward direction into wedging engagement with the disc recess first side wall and bar first side wall, the first wedge having a radially inner end wall in spaced opposed relation to the disc recess end wall, the disc recess end wall and first wedge end wall converging towards each other in a direction transversely of the disc, the second wedge being disposed between the disc recess end wall and first wedge end wall and movable therebetween in a direction transversely of the disc into wedging engagement with the disc recess end wall and first wedge end wall, and means for urging the second wedge in said transverse direction and thereby urging the first wedge in said outward direction, said urging means including a bolt disposed in said transverse direction and a nut engaging the bolt, said urging means, upon the nut being tightened on the bolt, maintaining tension on said wedges and holding the wedges securely in said wedging engagement.

2. The rotor assembly of claim 1 wherein the second impeller bar retaining means for each disc recess second side wall includes means interlocking the disc recess and bar second side wall effective to restrain radially outward movement of the bar when the first and second wedges are in said wedging engagement.

3. The rotor assembly of claim 2 wherein the urging means for the second wedge further comprises a plate disposed adjacent the converging ends of the disc recess and first wedge end wall and overlapping the disc, the bolt being a headed bolt extending transversely of the disc through the plate and the second wedge, and the nut upon being tightened on the bolt urges the second wedge toward the plate and into such wedging engagement with the first wedge.

4. The rotor assembly of claim 3 wherein the second impeller bar retaining means comprises complementary reliefs in the disc recess second side wall and bar second side wall and an impeller bar retainer member disposed therein and secured to the disc, said reliefs and retainer member extending axially of the disc, and wherein said wedging engagement of the first and second wedges maintains said relief in the impeller bar in engagement with the retainer member.

5. The rotor assembly of claim 4 wherein each impeller bar includes an axial end face extending transversely of said first and second side walls thereof and disposed adjacent an outer axial face of one of the rotor discs, and including third retaining means operative between said axial end face of the bar and said outer face of the disc effective to restrain movement of the impeller bar in one axial direction relative to said disc, the third retaining means being in addition to said first and second retaining means.

6. The rotor assembly of claim 5 wherein each of said impeller bar retaining members includes an axial end face adjacent said axial end face of the bar and said outer face of the disc, and wherein the third retaining means includes a block secured to said axial end face of the impeller bar retainer member and engaging said axial end face of the bar and said outer face of the disc.

7. The rotor assembly of claim 1 including third impeller bar retaining means at each end of said second retaining means, each such third impeller bar retaining means including at least one retainer overlapping adjacent portions of a selected one of the impeller bars and of one of the rotor discs and being operative to restrain movement of the selected impeller bar axially of the rotor assembly, the third retaining means being in addition to said first and second retaining means.

* * * * *

UNITED STATES PATENT AND TRADEMARK OFFICE

CERTIFICATE OF CORRECTION

PATENT NO. : 4,925,114

DATED : May 15, 1990

INVENTOR(S) : David A. Ostergaard

It is certified that error appears in the above-identified patent and that said Letters Patent is hereby corrected as shown below:

In the Detailed Description Column 2, Line 33 change "discs", to --discs 11--.

Column 3, Line 30 change "discs 1", to --discs 11--.

Column 4, Line 16 change "washer 40", to --washer 41--.

In claim 1, Column 5, Line 26

Change "side walls," to --side wall,--.

In claim 1, column 5, Line 27 change "walls", to --wall--.

Signed and Sealed this

Twenty-fifth Day of February, 1992

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,925,114

DATED : May 15, 1990

INVENTOR(S) : David A. Ostergaard

It is certified that error appears in the above-identified patent and that said Letters Patent is hereby corrected as shown below:

In the sheets of Drawings, sheet 3 of 3 should be deleted, sheet 1 of 3 should be added as shown on the attached sheet.

FIG 1
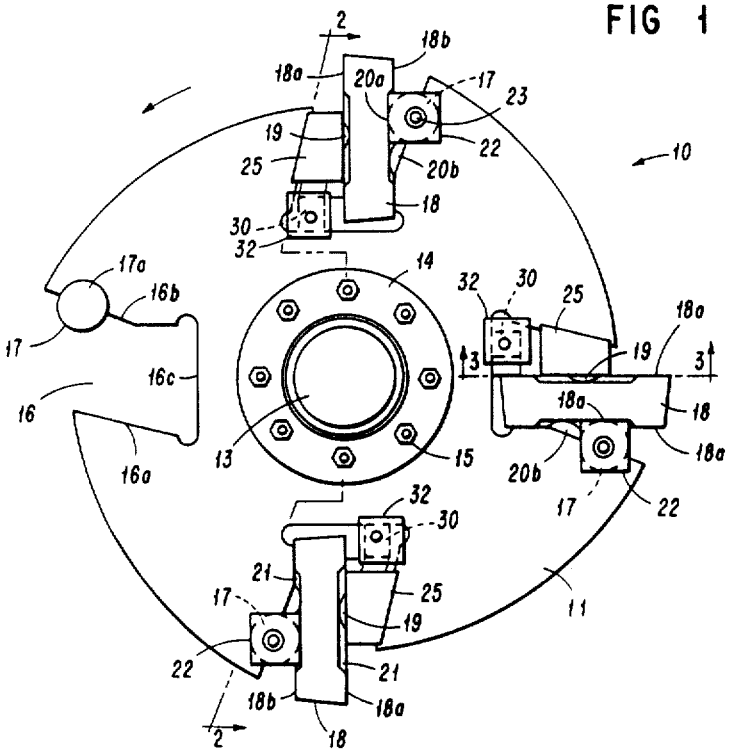
FIG 4
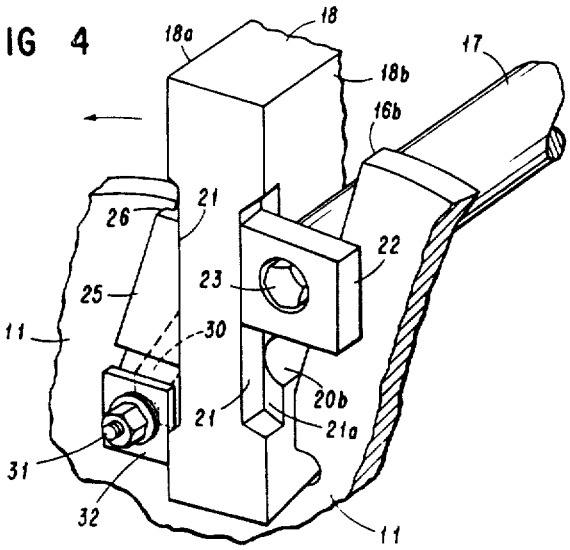
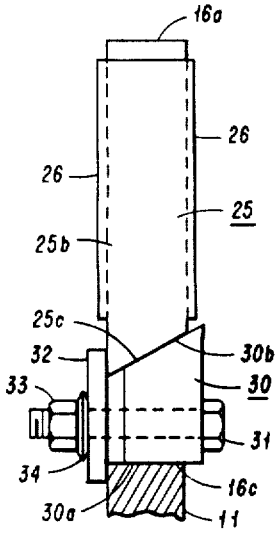
FIG 3